US006085629A

United States Patent [19]

Thiesen et al.

[11] Patent Number: 6,085,629

[45] Date of Patent: Jul. 11, 2000

[54] WEAPON SYSTEM

[75] Inventors: Stefan Thiesen, Willich; Jürgen Böcker, Oberhausen; Helmut Ortmann, Duisburg; Dieter Jungbluth, Herschbach, all of Germany

[73] Assignee: Rheinmetall W & M GmbH, Unterlüss, Germany

[21] Appl. No.: 09/061,338

[22] Filed: Apr. 17, 1998

[30] Foreign Application Priority Data

Apr. 18, 1997 [DE] Germany ..... 197 16 227

[51] Int. Cl.[7] ..... B64D 1/04; F41G 3/08

[52] U.S. Cl. ..... 89/6.5; 89/41.03

[58] Field of Search ..... 89/6.5, 6, 41.03; 102/215

[56] References Cited

U.S. PATENT DOCUMENTS

| | | | |
|---|---|---|---|
| 3,814,017 | 6/1974 | Backstein et al. | 102/215 |
| 4,528,891 | 7/1985 | Brunello et al. . | |
| 4,686,885 | 8/1987 | Bai | 89/6.5 |
| 4,711,152 | 12/1987 | Fortunko | 89/6.5 |
| 4,750,424 | 6/1988 | Hau . | |
| 5,351,597 | 10/1994 | Holmstrom et al. | 89/6.5 |
| 5,413,029 | 5/1995 | Gent et al. | 89/41.03 |
| 5,775,636 | 7/1998 | Vig et al. | 244/3.24 |

FOREIGN PATENT DOCUMENTS

| | | |
|---|---|---|
| 650 026 | 4/1995 | European Pat. Off. . |
| 2117345 | 7/1972 | France . |
| 41 37 819A1 | 5/1993 | Germany . |
| 42 18 118A1 | 12/1993 | Germany . |

*Primary Examiner*—Michael J. Carone
*Assistant Examiner*—Jeffrey Howell
*Attorney, Agent, or Firm*—Venable; George H. Spencer; Norman N. Kunitz

[57] ABSTRACT

A weapon system includes a weapon having a chamber; a data input device; an aiming mechanism; and an ammunition unit that can be fired with the weapon. The ammunition unit includes a data memory for storing ammunition-specific data; and a microcontroller arranged on or in the ammunition unit and being connected, when the ammunition unit is inside the chamber of weapon, to the data input device, the aiming mechanism and the data memory. The microcontroller determines aiming signals necessary to control the aiming mechanism as a function of ammunition-specific, target-specific, and weapon-specific data transmitted to the microcontroller. The microcontroller transmits the aiming signals to the aiming mechanism.

18 Claims, 2 Drawing Sheets

WEAPON SYSTEM

CROSS-REFERENCE TO RELATED APPLICATIONS

Priority is claimed with respect to Application No. 197 16 227.4 filed in Germany on Apr. 18, 1997, the disclosure of which is incorporated herein by reference.

BACKGROUND OF THE INVENTION

The invention concerns a weapon system, comprising a weapon, an aiming mechanism for controlling elevation and angle of the weapon, and a unit of ammunition to be fired with the weapon.

The main weapon in a battle tank is normally controlled with a fire-control computer and an associated aiming mechanism. German Patent document DE 41 37 819 A1 discloses storage of ammunition-specific data for identifying the ammunition, such as ammunition type, batch or lot number, date of manufacture etc., directly on a data memory card arranged on the ammunition. Following the insertion of the respective cartridge into the weapon chamber, these data are read automatically with a scanning device and transmitted to the fire-control computer. Taking into account these data, as well as the target-specific and system-specific data (e.g. "system error"), the fire-control computer then generates aiming signals for controlling the aiming mechanism.

A disadvantage of this known weapon system is that only the ammunition identified by the fire-control computer can be fired, meaning only the ammunition previously detected by type. Since the identification of the ammunition according to type is made before the ammunition batch is delivered (otherwise the respective battle tank would not be ready for action when the ammunition is delivered), the fire-control computer is programmed with a unit data record that is created on the basis of developmental patterns. However, the average behavior of the actually delivered ammunition as a rule does not correspond to the fixedly programmed unit firing table. Some ammunition batches consequently deviate greatly from the firing table of the fire-control computer. Even small deviations from batch to batch within the same type of ammunition frequently lead to a somewhat changed firing table. The resulting decline in the hitting accuracy must either be accepted, or the program of the respective fire-control computer must be adjusted correspondingly to the respective batch.

Another disadvantage of the known weapon system with identifiable ammunition, meaning with previously detected ammunition type, is that developmental technical improvements in the ammunition to improve the combat efficiency cannot be utilized immediately because the rather involved steps of "type detecting" with a corresponding computer chip-card must first be taken for the complete fleet of battle tanks. For that reason, the "resources of good ammunition batches" cannot be utilized to increase combat efficiency because the "old type detecting" must take place for known weapon systems and continuous ammunition production. Added to this is the fact that a present-day battle tank has only a limited number of plug-in ports for the new type-detecting.

The German Patent Document DE-OS 2 059 665 discloses a device for determining a propellant powder temperature of an electrically ignitable cartridge inside a weapon chamber. The respective temperature data are transmitted to the fire-control computer and serve to correct the aiming and/or ignition signals determined by the fire-control computer.

SUMMARY OF THE INVENTION

It is an object of the present invention to provide a weapon system which, for different ammunition types as well as varied batches of the same type of ammunition, and by taking into account individual tube characteristics and equipment characteristics, easily permits a high first hit probability (FHP) for the ammunition to be fired individually from each battle tank, without requiring the step of first detecting the ammunition type in the fire-control unit.

The above and other objects are accomplished by the provision of a weapon system, comprising: a weapon including a chamber; at least one data input device; an aiming mechanism; and an ammunition unit that can be fired with the weapon, the ammunition unit including: a data memory for storing ammunition-specific data; and a microcontroller or microprocessor arranged on or in the ammunition unit and being connected, when the ammunition unit is inside the chamber of weapon, to the at least one data input device, the aiming mechanism and the data memory, the microcontroller determining aiming signals necessary to control the aiming mechanism as a function of ammunition-specific, target-specific, and weapon-specific data transmitted to the microcontroller, the microcontroller transmitting the aiming signals to the aiming mechanism.

The invention is essentially based on the idea of replacing the traditional means of controlling weapon systems with a fire-control computer through the system interplay of an ammunition-controlled and an equipment-controlled weapon system. This is achieved by providing a microcontroller with data memory for storing the ammunition-specific data in or on the respective ammunition unit. A data pre-processing of ammunition-specific data then takes place in the microprocessor of the ammunition unit while the weapon is in the loaded state. The data pre-processed and/or pre-compressed in this way are then read out to another (second) microcontroller or microprocessor, located outside of the ammunition unit. This second microcontroller subsequently carries out the data exchange between an aiming controller (third microcontroller) and the data input devices provided for the target-specific and system-specific data.

The information transmitted from the second microcontroller to the aiming controller is a correction value for altitude and azimuth, which can be considered a momentary individual system error. By means of the optical aiming device used by the gunner's sight, the aiming controller then ensures a tracking of the tube parallel to the optical aiming device and via the aiming mechanism. This ensures good coincidence conditions.

In this system of three microcontrollers, the microcontroller in the ammunition unit can also take over additional tasks of the second "external" microcontroller, and depending on the embodiment, can take over the function of the fire-control system required for traditional weapon systems.

One advantageous embodiment of the invention provides that the microcontroller in the ammunition unit completely takes over the tasks of the second microcontroller, so that the second microcontroller can be omitted.

The weapon system according to the invention has a number of advantages:

The involved, cost-intensive type detecting for new ammunition in the fire-control computer chip-cards for all battle tanks in a battle tank fleet is not necessary. A considerable increase in the combat efficiency of the fleet of battle tanks is thus reached in a simple way.

Furthermore, the individual batch qualities of an ammunition batch can be taken into consideration directly during a quality inspection in that the data stored in the data memory of the microcontroller for the respective ammunition unit (or the microcontroller program) can be changed correspondingly.

In addition, the ammunition batches must no longer be adjusted exactly during the manufacture, so that the "resources of good batches" as well as developmental technical improvements can be utilized immediately for an increase in the combat efficiency since the link to a fire-control computer chip-card is omitted.

Finally, an effective ammunition management is possible because changes detected in the ammunition batches during the monitoring of the ammunition at predetermined time intervals can be taken into consideration by changing the data content of the data memory attached to the respective ammunition unit. As a result of this, an optimum use of the ammunition batch during the combat operation is possible.

In order to achieve a high first hit probability (FHP), it has proven advantageous if the microcontroller is connected to a temperature sensor inside the ammunition unit for determining the temperature of the propellant, as well as to a humidity sensor for determining the humidity of the propellant.

Furthermore, it has also proven useful to take into account the respective air pressure when determining the aiming signals and the ignition signals and to connect the microcontroller to a respective air-pressure sensor.

It has proven particularly advantageous if a tube chip-card evaluator is provided as a data input device, by way of which the weapon-specific data, stored on a replaceable chip-card memory (tube chip-card), are read into the weapon system and are transferred to the second microcontroller (outside of the ammunition unit). These data are then used to generate corresponding information for the aiming controller.

Another data input device, e.g. for the commander of a respective battle tank, preferably is used as a control unit. Among other things, this device can be used by the commander to poll the tactical firing program (number of shots and spatial distribution), stored in a combat module of the ammunition, and, if available, to give orders.

Furthermore, it has proven advantageous to use an evaluation device to determine the azimuth deviation of the projectile from the tracer of the respectively preceding firing and to take the corresponding influencing variables into account for the successive firing.

Insofar as the cartridge propulsion medium is provided with controllable combustion components, a control unit for the ignition and combustion of the charge is provided, so that for the firing clearance, the respective firing impulse triggers the control unit, previously supplied with the current data by the microprocessor.

The following embodiments, explained with the aid of the figures, illustrate other details and advantages of the invention.

DETAILED DESCRIPTION OF THE INVENTION

Figure 1:
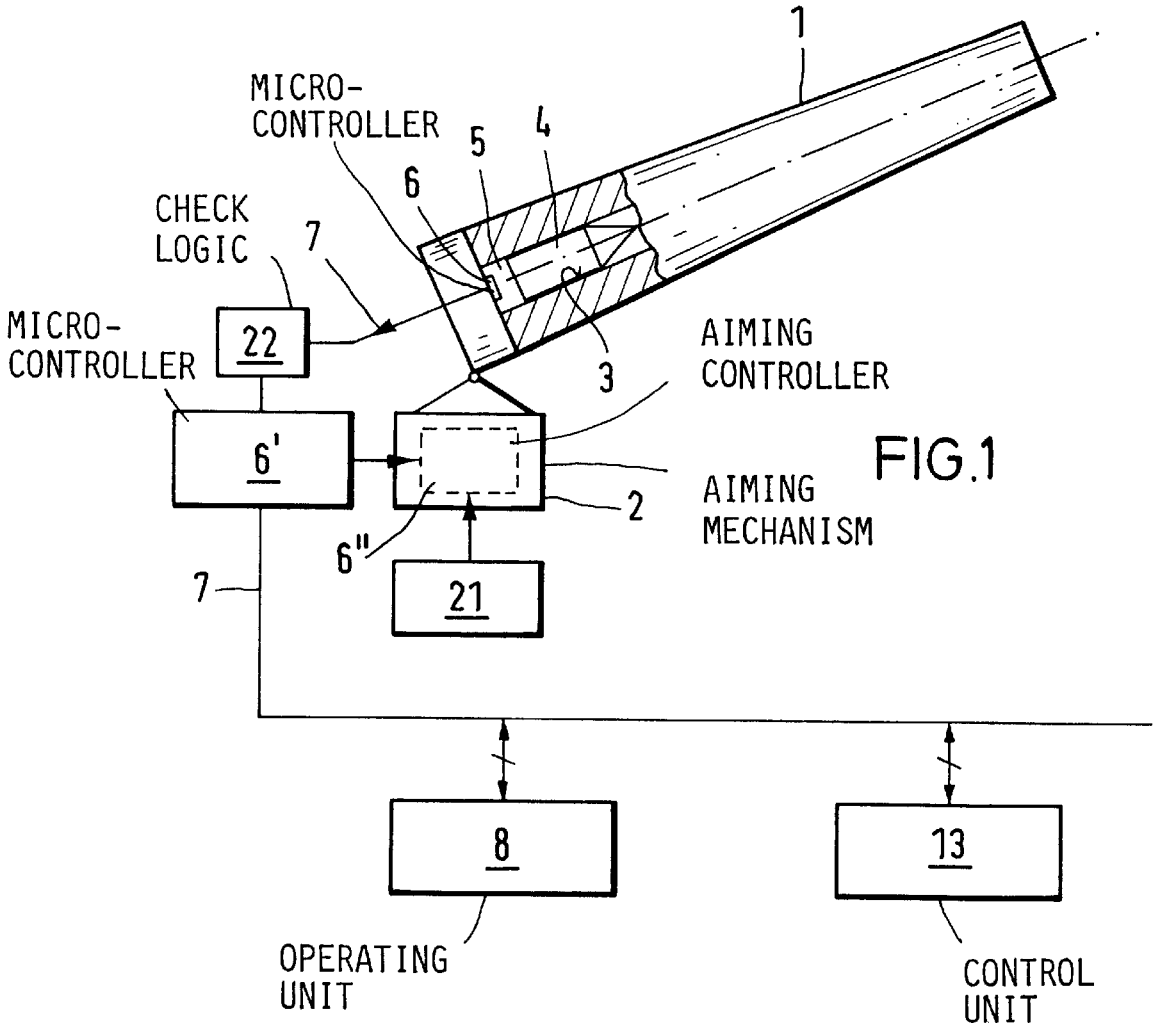
FIG. 1 is a schematic representation and partial block diagram of a weapon system according to the invention.

Referring to FIG. 1, there is shown a tube weapon 1 of a battle tank, which is mechanically coupled with an aiming mechanism 2, indicated only schematically here. A chamber 3 of weapon 1 contains one cartridge 4 with a first microcontroller or microprocessor 6 integrated on an inside of a bottom 5 of cartridge 4. First microcontroller 6 is connected via lines 7 (data bus and control bus) and an electronic check logic 22, to a second microcontroller or microprocessor 6' (external with respect to cartridge 4), an aiming controller 6" in aiming mechanism 2, as well as to other components, of which only two data input devices 8 and 13 (e.g. an operating unit 8 for the gunner and a control unit 13 for the commander) are shown.

Figure 2:
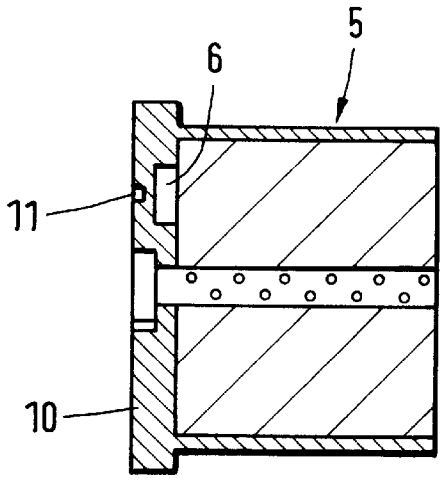
FIG. 2 is a cross section of a cartridge bottom with integrated microcontroller.

First microcontroller 6 must be arranged inside cartridge 4 so that no data can fall into the wrong hands after the firing, meaning it must be destroyed completely by the heat or the pressure generated during the firing. It has therefore proven advantageous to arrange microcontroller 6 on the inside of the bottom plate 10 (see FIG. 2) of cartridge bottom 5 and to connect it via lines to respective outside contacts 11. Outside contacts 11 can also be designed as annular contacts. By way of these contacts, first microcontroller 6 is connected galvanically via lines 7 to a second microcontroller 6' and aiming controller or processor 6".

The arrangement of first microcontroller 6 on the inside of bottom plate 10 furthermore has the advantage that first microcontroller 6 is protected against dirt and mechanical damage, etc.

Figure 3:
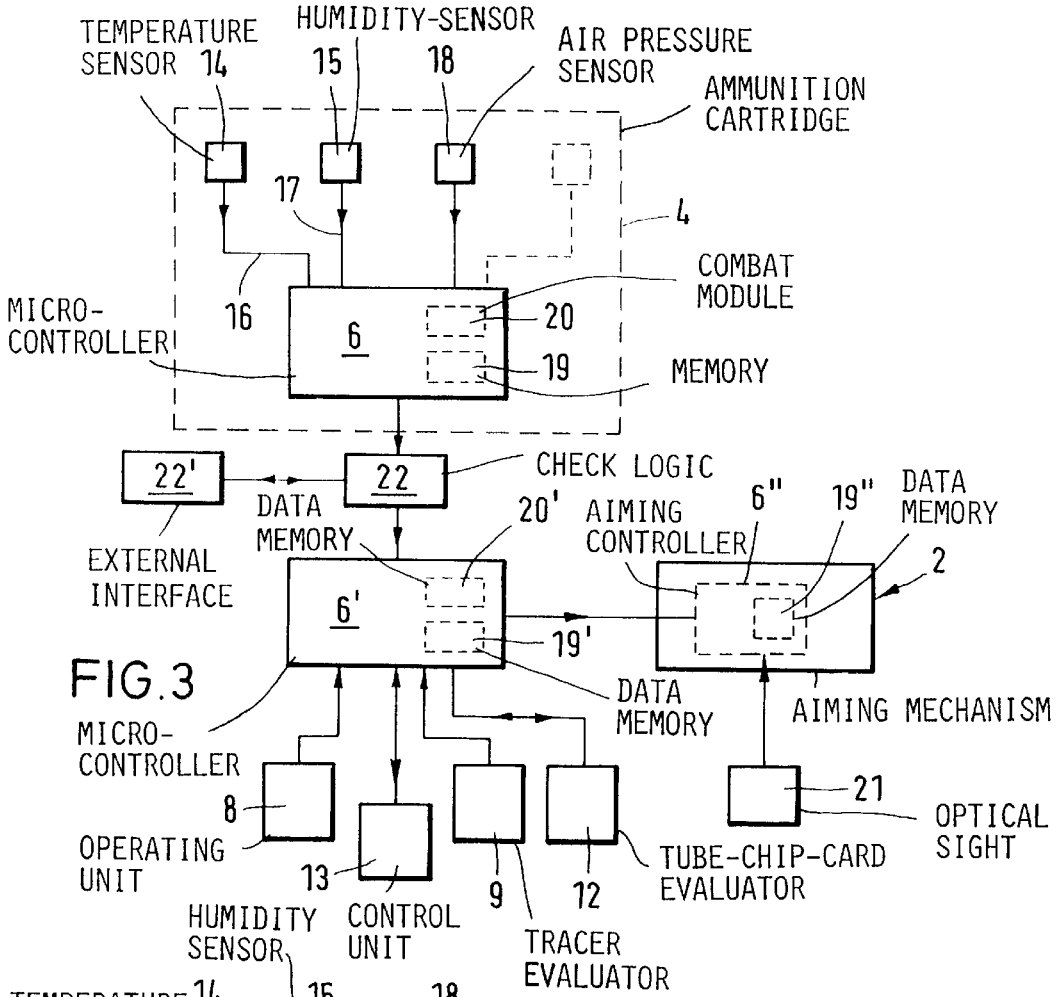
FIG. 3 is block diagram of a first exemplary embodiment of a weapon system according to the invention.

FIG. 3 shows a block diagram with the two microcontrollers 6 and 6', aiming controller 6", as well as several components of the weapon system, connected to the controllers. For example gunner operating unit 8 and commander control unit 13 along with a tube chip-card evaluator 12 and an evaluator 9 for the tracer from a fired projectiles, are connected to second microcontroller 6'.

Separate sensors 14, 15 are arranged in cartridge 4 to determine propellant temperature as well as to determine the propellant humidity, which sensors are connected to first microcontroller 6 via electrical lines 16, 17, respectively. A sensor 18 for measuring air pressure is also provided.

In addition to a processor and a clock generator, first microcontroller 6 also comprises a write-in/read-out memory 19, shown with dashed lines in FIG. 3, for storing the batch data determined anew during a respective quality inspection, as well as a combat module 20 for storing tactical combat programs for special ammunition (e.g. for high-explosive and fragmentation cartridges)

The operation of the weapon system according to the invention is explained in further detail in the following with the aid of the exemplary embodiment shown in FIG. 3.

The commander first inserts a replaceable tube chip-card into a tube-chip-card reader that is connected via the tube-chip-card evaluator 12 to second microcontroller 6'. Only then can the weapon system be activated.

Cartridge 4 is subsequently loaded. The closing of the breech assembly for the respective weapon 1 will connect galvanic line 7 between microcontrollers 6 and 6', so that first microcontroller 6 will be activated by supplying external energy to the system. Following this, the combat program is copied from the combat module 20 to a data memory 20' of second microcontroller 6'. On the other hand, the quality inspection data from data memory 19, together with the current data for propellant temperature, propellant humidity and air pressure are preprocessed in first microcontroller 6, and the resulting values are transmitted to a write-in/read-out memory 19' of second microcontroller 6'.

During the transmission of data from microcontroller 6 to microcontroller 6', the data must pass through a check logic 22 that is installed in front of microcontroller 6'. There, the data are checked for plausibility (e.g. temperature range, average point of impact, etc.). If this plausibility check indicates erroneous data or if no data at all arrive from microcontroller 6 because of a defect, then an external interface 22' is automatically activated. External interface 22' is connected to a plug-in unit (not shown) for an additional chip-card, which is included with each ammunition pallet and contains the standard values for an emergency operation (e.g. equilibrium moisture content for the propellant). By using a sensor arranged on a chip card, chip temperature (meaning the temperature in the combat zone) can be used as the temperature for the emergency operation.

The data are updated at regular intervals with the aid of microcontroller 6 (e.g., at 1-minute cycles), that is as long as the cartridge is loaded and the battle tank is ready for combat.

Control unit 13 for the commander is used to carry out the option "tactical firing" (firing volley) in accordance with the program stored in the combat module 20 and is not activated for the combat mode "individual firing."

The following sequence takes place for the combat mode "individual firing": Through a measuring of a target range, e.g. with the aid of a laser range meter that is known per se and through an automatic feeding of the range data via data input device 8 to microcontroller 6', microcontroller 6' generates current correction values for aiming the tube with respect to azimuth and elevation by using the preprocessed quality inspection data in data memory 19' and the data from the tube chip-card evaluator 12 (tube statics, total number of times the weapon has been fired and information on possible previous firings that may affect the tube), as well as the data from a tracer evaluator 9 (if these are available as a result of a previous firing).

Microcontroller 6' writes these aiming correction values into data memory 19" of aiming controller 6" (third microcontroller). It is the task of microcontroller 6" to generate aiming signals for aiming mechanism 2 by processing the data from an optical sight 21 used by the gunner, and the correction values from the data memory 19", and thus ensure the tracking of the tube.

A precise aiming of the tube occurs in a manner known per se, with the aid of optical sight 21 for the gunner, so that no additional data or signals are exchanged when the firing is triggered, and so that the coincidence window and the coincidence frequency (as is standard nowadays) are not impaired.

Aiming controller 6" can acknowledge in an advantageous way the reception of the data in data memory 19" by signaling this on an additional optical display (not shown) for the commander and, if necessary, also for the gunner and can thus indicate a "firing readiness."

Figure 4:
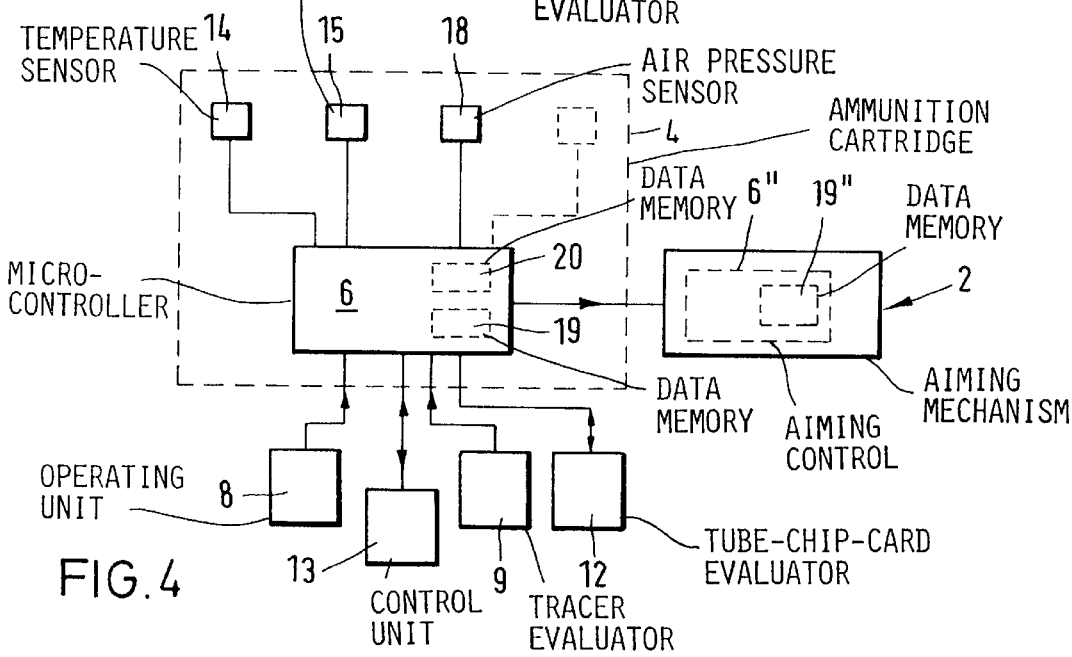
FIG. 4 is a block diagram of a second exemplary embodiment of a weapon system according to the invention.

The embodiment shown in FIG. 4 is a special variation of the embodiment shown in FIG. 3. In the FIG. 4 embodiment, microcontroller 6, which is integrated into the ammunition, also assumes the tasks of the microcontroller 6', so that microcontroller 6' can be omitted. The operation of the embodiment shown in FIG. 4 essentially corresponds to the operation of the embodiment described previously with the aid of FIG. 3, wherein the same reference numbers are used for the same components.

Of course, the invention is not limited to the above mentioned exemplary embodiments. Thus, the microcontroller of the ammunition unit can also be connected to and can operate jointly with other functional units and/or sensors. For example, wind direction and wind velocity can be measured and used to obtain the aiming signals.

Furthermore, when retrofitting existing battle tanks with the new weapon system, the existing fire control unit can remain inside the tank and can function as an "emergency firing unit."

The connection between the microcontroller on the ammunition side and the external components does not necessarily have to be via a galvanic arrangement provided on the weapon. Rather, a non-contacting connection, e.g., by means of a transponder, is conceivable as well.

Since no energy-supply elements are generally stored in the ammunition unit, owing to the long storage times (frequently greater than 10 years), microcontroller 6 on the ammunition side is activated, only when the cartridge is loaded, by the energy supply for the respective battle tank.

In addition, it is not necessary for microcontroller 6", which is associated with aiming mechanism 2, to be located in the same location as the mechanical parts for the aiming mechanism. Rather, it can be arranged inside a central electronic system. It is furthermore conceivable that an already existing central computer takes over the function of microcontroller 6".

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A weapon system, comprising:

a weapon including a chamber;

at least one data input device;

an aiming mechanism; and an ammunition unit that can be fired with the weapon, the ammunition unit including:

a data memory for storing ammunition-specific data; and a microprocessor arranged on or in the ammunition unit and being connected, when the ammunition unit is inside the chamber of the weapon, to the at least one data input device, the aiming mechanism and the data memory, the microprocessor determining aiming signals necessary to control the aiming mechanism as a function of ammunition-specific, target-specific, and weapon-specific data transmitted to the microprocessor and transmitting the aiming signals to the aiming mechanism.

2. A weapon system according to claim 1, the weapon system further including a chip-card evaluator for reading into the weapon system the weapon-specific data stored in a replaceable chip-card memory for transmission to the microprocessor for determining the aiming signals.

3. A weapon system according to claim 1, further including a control unit for at least one of a gunner and a commander of a battle tank for specifying at least one of a firing readiness, a number of rounds for the weapon, a firing program, and a firing clearance.

4. A weapon system according to claim 1, wherein the ammunition unit includes a temperature sensor and the first microprocessor is connected to the temperature sensor for determining temperature of a propellant in the ammunition unit.

5. A weapon system according to claim 1, wherein the ammunition unit includes a humidity sensor and the first microprocessor is connected to the humidity sensor for determining humidity of a propelland humidity in the ammunition unit.

6. A weapon system according to claim 1, wherein the ammunition unit includes an air pressure sensor and the first microprocessor is connected to the air-pressure sensor.

7. A weapon system according to claim 1, wherein the ammunition unit comprises a cartridge having a bottom plate closing a bottom of the cartridge, and the first microprocessor is arranged inside of the bottom plate of the cartridge bottom.

8. A weapon system according to claim 1 wherein the first microprocessor is supplied with current from a current source external to the ammunition unit.

9. A weapon system according to claim 1, and further including a non-contacting connection between the first microprocessor and components located external to the ammunition unit.

10. A weapon system, comprising:

a weapon including a chamber;

at least one data input device;

an aiming mechanism;

an ammunition unit that can be fired with the weapon, the ammunition unit including:

a data memory for storing ammunition-specific data, and a first microprocessor arranged on or in the ammunition unit for preprocessing of the ammunition-specific data and being linked to the data memory; and a second microprocessor, external with respect to the ammunition unit, linked to the first microprocessor, the at least one data input device, and the aiming mechanism, for determining aiming signals necessary for controlling the aiming mechanism from the ammunition-specific data, target-specific data, and weapon-specific data transmitted to the second microprocessor, and transmitting the aiming signals to the aiming mechanism.

11. A weapon system according to claim 10, further including a tube chip-card evaluator for reading into the weapon system weapon-specific data stored on a replaceable chip-card memory and transmitting the weapon-specific data to the second microprocessor for determining the aiming signals.

12. A weapon system according to claim 10, further including a control unit for at least one of a gunner and a commander of a battle tank for specifying at least one of a firing readiness, a number of rounds for the weapon, a firing program, and a firing clearance.

13. A weapon system according to claim 10, wherein the ammunition unit includes a temperature sensor and the first microprocessor is connected to the temperature sensor for determining temperature of a propellant in the ammunition unit.

14. A weapon system according to claim 10, wherein the ammunition unit includes a humidity sensor and the first microprocessor is connected to the humidity sensor for determining humidity of a propellant humidity in the ammunition unit.

15. A weapon system according to claim 10, wherein the ammunition unit includes an air pressure sensor and the first microprocessor is connected to the air-pressure sensor.

16. A weapon system according to claim 10, wherein the ammunition unit comprises a cartridge having a bottom plate closing a bottom of the cartridge, and the first microprocessor is arranged inside of the bottom plate of the cartridge bottom.

17. A weapon system according to claim 10, wherein the first microprocessor is supplied with current from a current source external to the ammunition unit.

18. A weapon system according to claim 10, and further including a non-contacting connection between the first microprocessor and components located external to the ammunition unit.

* * * * *